US011690158B2

(12) United States Patent
Deuringer

(10) Patent No.: US 11,690,158 B2
(45) Date of Patent: Jun. 27, 2023

(54) CONTROLLING AN X-RAY TUBE

(71) Applicant: Siemens Healthcare GmbH, Erlangen (DE)

(72) Inventor: Josef Deuringer, Herzogenaurach (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 17/393,668

(22) Filed: Aug. 4, 2021

(65) Prior Publication Data

US 2022/0053626 A1 Feb. 17, 2022

(30) Foreign Application Priority Data

Aug. 11, 2020 (DE) ..... 10 2020 210 118.3

(51) Int. Cl.
*H05G 1/08* (2006.01)
*H05G 1/26* (2006.01)
*H05G 1/52* (2006.01)

(52) U.S. Cl.
CPC ..... *H05G 1/085* (2013.01); *H05G 1/265* (2013.01); *H05G 1/52* (2013.01)

(58) Field of Classification Search
CPC ..... H05G 1/085; H05G 1/52
See application file for complete search history.

(56) References Cited

U.S. PATENT DOCUMENTS

2002/0034279 A1 3/2002 Hirano et al.
2009/0058319 A1 3/2009 Berk et al.
2009/0290683 A1 11/2009 Loef et al.
2015/0084502 A1 3/2015 Deuringer et al.
2016/0322972 A1* 11/2016 Hu ..... H03K 19/018521
2019/0159326 A1 5/2019 Proell et al.
2021/0007210 A1* 1/2021 Steadman Booker .. H01J 35/14

FOREIGN PATENT DOCUMENTS

DE 60015301 T2 3/2006
DE 102006038601 A1 2/2008
DE 102007042108 A1 3/2009
DE 102009035547 A1 2/2011
DE 102013219173 A1 3/2015
DE 102017220991 A1 5/2019
JP 2014229374 A * 12/2014

OTHER PUBLICATIONS

German Office Action and English translation thereof dated Jun. 21, 2021.
German Decision to Grant and English translation thereof dated Dec. 16, 2021.
German Office Action dated Jun. 21, 2021.

* cited by examiner

*Primary Examiner* — Chih-Cheng Kao
(74) *Attorney, Agent, or Firm* — Harness, Dickey & Pierce, P.L.C.

(57) ABSTRACT

A method is for controlling an X-ray tube including at least one grid electrode arranged between an anode electrode and a cathode electrode. In an embodiment, the method includes focusing, via a focusing unit, a flow of electrons from the cathode electrode to the anode electrode; applying in a first switching state, a first electrical grid potential to the at least one grid electrode via a switching unit, to pinch off the flow of electrons between the anode electrode and the cathode electrode; and applying in a second switching state, a second electrical grid potential to the at least one grid electrode to enable the flow of electrons, at least the second electrical grid potential being provided by the focusing unit.

28 Claims, 1 Drawing Sheet

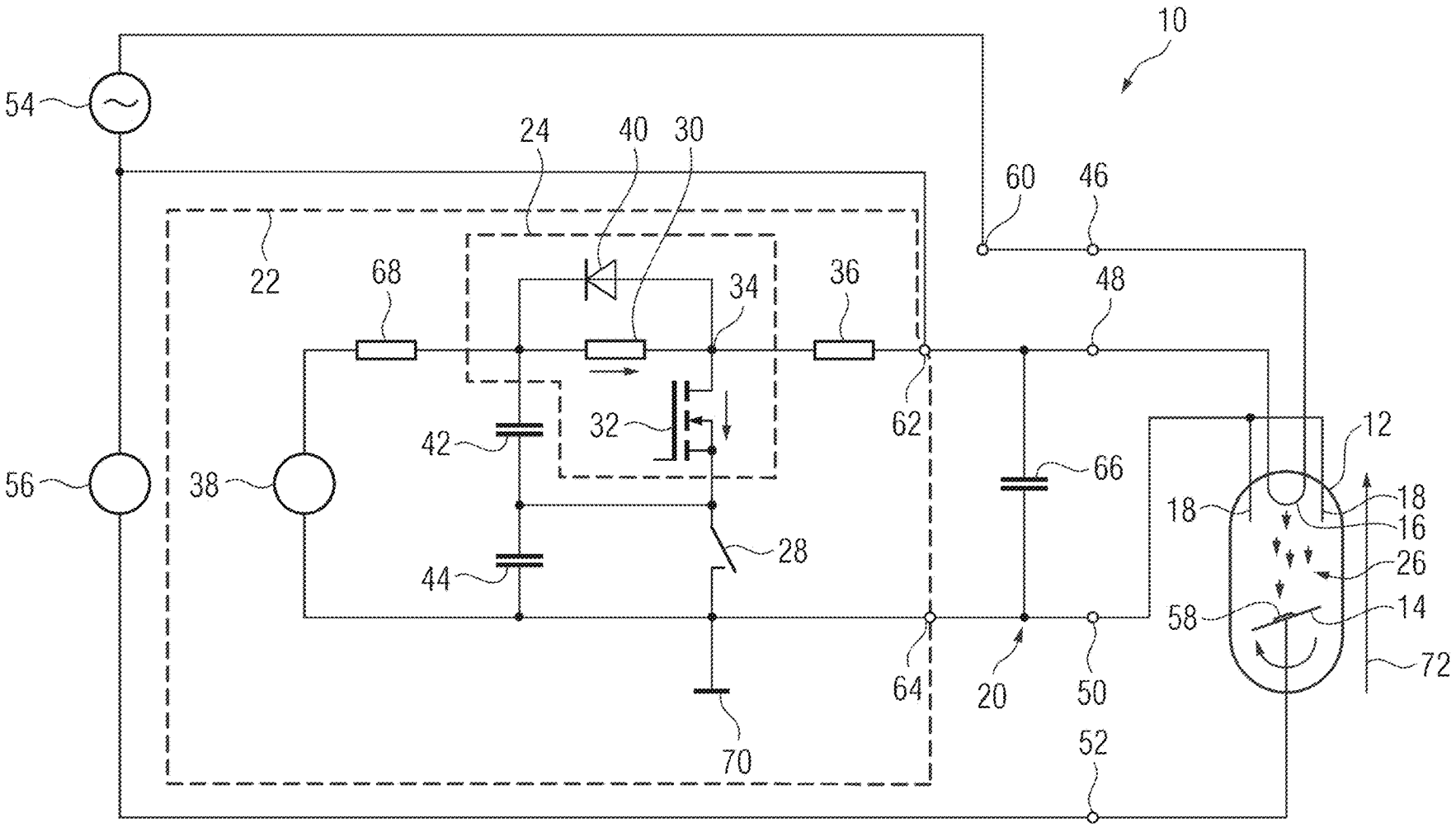
10
12
14
16
18
18
20
22
24
26
28
30
32
34
36
38
40
42
44
46
48
50
52
54
56
58
60
62
64
66
68
70
72

CONTROLLING AN X-RAY TUBE

PRIORITY STATEMENT

The present application hereby claims priority under 35 U.S.C. § 119 to German patent application number DE 102020210118.3 filed Aug. 11, 2020, the entire contents of which are hereby incorporated herein by reference.

FIELD

Example embodiments of the invention generally relate a method for controlling an X-ray tube, which has at least one grid electrode arranged between an anode electrode and a cathode electrode, wherein a flow of electrons from the cathode electrode to the anode electrode is focused via a focusing unit, and the at least one grid electrode, in a first switching state, has a first electrical grid potential applied to it via a switching unit for pinching off the flow of electrons between the anode electrode and the cathode electrode and, in a second switching state, has a second electrical grid potential applied to it for enabling the flow of electrons.

Example embodiments of the invention further generally relate to a switching arrangement for controlling an X-ray tube, which has at least one grid electrode arranged between an anode electrode and a cathode electrode, with a focusing unit for focusing a flow of electrons from the cathode electrode to the anode electrode, and a switching unit, which is embodied to pinch off the at least one grid electrode in a first switching state with a first electrical grid potential for pinching off the flow of electrons between the anode electrode and the cathode electrode and in a second switching state to apply a second electrical grid potential enabling the flow of electrons.

Finally, example embodiments of the invention also generally relate to an X-ray device with an X-ray tube, which has at least one grid electrode arranged between an anode electrode and a cathode electrode, and a switching arrangement for controlling an X-ray tube connected to the X-ray tube via a connecting line.

BACKGROUND

X-ray tubes, methods for their operation and also control facilities for them are widely known in the prior art. X-ray tubes are specific types of vacuum electron tubes, which serve in the present case, when working according to specification, to be able to generate X-ray radiation for a diversity of purposes. X-ray devices are frequently also a component of imaging apparatuses, as are employed for example in medical diagnostics or also in quality assurance. In such cases the X-ray tube as a rule uses a principle in which, through suitable setting of an electrical voltage between the cathode electrode and the anode electrode, the electrons are strongly accelerated in the manner of a flow of electrons and strike the anode electrode under predetermined conditions. In this process X-ray radiation is released. The release of X-ray radiation can be influenced inter alia by an area that it strikes on the anode, which can be set at least partly by focusing the flow of electrons.

In generic X-ray tubes an anode-cathode voltage present between the anode electrode and the cathode electrode can be between around 60 kV and around 150 kV, when the X-ray tube is embodied with one pole. With an X-ray tube embodied with two poles this voltage can amount to between around 30 kV and around 75 kV.

In the prior art it is usual to realize the focusing of the flow of electrons by way of magnetic fields, which are provided via a corresponding magnetic field unit. To interrupt the provision of X-ray radiation it has previously been usual to supply a suitable electrical potential to the at least one grid electrode, so that a grid cathode voltage occurs between the grid electrode and the cathode electrode, which can lie in a range of around a few hundred volts to around 4 kV, for example. A pinching-off of the flow of electrons in the X-ray tube can be achieved with such a grid cathode voltage, so that essentially no electrons can reach the anode electrode any longer. The grid cathode voltage at which this effect occurs is occasionally also called the pinch-off voltage.

The area of the anode electrode, which the electrons essentially strike during the generation of x-ray radiation, also called the focal point, is advantageously to be adapted to respective operating modes, in particular in relation to the respective imaging method. This enables a respective image quality to be achieved for a respective application. For this purpose a suitable focusing can be set, or a compromise can be set for example with regard to an image quality and to a load on the X-ray tube that is as low as possible.

With many X-ray devices, in particular in angiography, this is only able to be realized with difficulty with magnetic field units as a result of the size required. Efforts are therefore being made to realize the focusing by way of magnetic fields through a focusing by way of electrical fields. For this purpose it is known that the at least one grid electrode, which is arranged for example at least in part between the cathode electrode and the anode electrode and/or at least in part also next to the cathode electrode, can have a suitable electrical potential for focusing applied to it. To this extent the term "between" also comprises an arrangement of the grid electrode at least partly in an area next to the cathode electrode. In this way the grid electrode can have delimiting plates next to the cathode electrode, bars between a cathode electrode embodied in segments and/or the like. A teaching of this type is known for example from DE 10 2013 219 173 A1, which discloses a power supply for an electrical focusing of electron beams. What is more DE 10 2009 035 547 A1 discloses a voltage setting element which is intended to be suitable for setting a cathode voltage of an X-ray tube.

Even if these teachings in the prior art are basically well-proven, there remains however at least one problem when discharging a generally comparatively long high-voltage cable for activating the X-ray tube when switching over from the pinch-off voltage to a predeterminable grid cathode voltage for focusing the flow of electrons.

In the aforementioned teachings the function of pinching off the flow of electrons is realized for example by a voltage converter with a galvanic separation for realizing a potential separation, for which purpose for example a correspondingly embodied transformer can be used, and with which the required pinch-off voltage can quickly be provided. Via a short circuit element the grid cathode voltage can quickly be reduced, for example to around zero V, through which also a discharging of a parasitic capacitance of the connecting cable can be achieved. With this switching concept an actual value acknowledgement is not realized as a rule because of the technical effort required, which is why the grid cathode voltage can only be provided with a low accuracy. For the pinching-off of the flow of electrons it is essentially sufficient to achieve at least the pinch-off voltage and at the same time adhere to the insulation stability of the system.

A development of the aforementioned construction makes provision for a cascade of transistors connected in series to the X-ray tube on the cathode side, which are controlled jointly. If the transistors are operated in a high-impedance operating state, because of the current through the X-ray tube, a corresponding voltage can arise as a type of negative feedback. Through this the pinch-off voltage can likewise be provided at least partly, in that namely a corresponding electrical potential of this voltage is given to the grid electrode of the X-ray tube. A regulation or a precise setting of the grid cathode voltage is not possible with this however.

With regard to the focusing by way of an electrical field the aforementioned voltage converter has likewise already been used. Since as a rule a passive DC rectifier circuit is provided at an output terminal of the voltage converter, the grid cathode voltage can only be changed slowly. A time constant can depend inter alia on a grid cathode capacitance and also on a discharge resistance connected in parallel hereto. Through this however only an imprecise setting of the grid potential can be achieved. What is more, the discharging with a discharging resistor can either lead to long time constants during discharging, in particular with a large resistance value of the discharging resistance, or to high power losses in the discharging resistor when the pinch-off voltage is present.

SUMMARY

At least one embodiment of the invention is directed to improving the use of the grid electrode for pinching off the flow of electrons and/or also for focusing the flow of electrons.

A method, a circuit arrangement and also an X-ray device in accordance with embodiments are proposed.

Advantageous developments emerge from the features of the claims.

With regard to a method, it is proposed in particular with at least one embodiment of the invention that at least the second electrical grid potential is provided by the focusing unit.

With regard to a circuit arrangement, it is proposed in at least one embodiment, in particular that the switching unit and the focusing unit are connected in series.

With regard to an X-ray device, it is proposed in at least one embodiment, in particular that the X-ray device has a circuit arrangement of at least one embodiment.

At least one embodiment of the present application is directed to a method for controlling an X-ray tube including at least one grid electrode arranged between an anode electrode and a cathode electrode, the method comprising: focusing, via a focusing unit, a flow of electrons from the cathode electrode to the anode electrode;

applying in a first switching state, a first electrical grid potential to the at least one grid electrode to pinch off the flow of electrons between the anode electrode and the cathode electrode; and applying in a second switching state, a second electrical grid potential to the at least one grid electrode to enable the flow of electrons, at least the second electrical grid potential being provided by the focusing unit.

At least one embodiment of the present application is directed to a circuit arrangement for controlling an X-ray tube, the X-ray tube including at least one grid electrode arranged between an anode electrode and a cathode electrode, the circuit arrangement comprising:

a focusing unit to focus a flow of electrons from the cathode electrode to the anode electrode; and a switching unit to apply a first electrical grid potential, for pinching off the flow of electrons between the anode electrode and the cathode electrode, to the at least one grid electrode in a first switching state, apply, in a second switching state, a second electrical grid potential enabling the flow of electrons, the switching unit and the focusing unit being connected in series.

At least one embodiment of the present application is directed to a circuit arrangement for controlling an X-ray tube, the X-ray tube including at least one grid electrode arranged between an anode electrode and a cathode electrode, the circuit arrangement comprising:

a series circuit including an electrical resistor and a transistor, to focus a flow of electrons from the cathode electrode to the anode electrode, a central terminal of the series circuit being electrically coupled to the at least one grid electrode; and a switch to apply a first electrical grid potential, for pinching off the flow of electrons between the anode electrode and the cathode electrode, to the at least one grid electrode in a first switching state, apply, in a second switching state, a second electrical grid potential enabling the flow of electrons, the switch and the series circuit being connected in series.

At least one embodiment of the present application is directed to a X-ray device comprising:

an X-ray tube, including at least one grid electrode arranged between an anode electrode and a cathode electrode; and the circuit arrangement of an embodiment, connected via a connecting line to the X-ray tube for controlling the X-ray tube.

BRIEF DESCRIPTION OF THE DRAWINGS

The example embodiments explained below involve preferred forms of embodiment of the invention. The features and combinations of features specified in the description and also the features and combinations of features described in the description of example embodiments given below and/or shown solely in the figures are not only able to be used in the combination specified in each case, but also in other combinations. Embodiments of the invention that are not shown and explained explicitly in the figures, but are able to be obtained and created from separated combinations of features from the explained forms of embodiment are thus included or to be viewed as disclosed. The features, functions and/or effects presented with the aid of the example embodiments, taken per se, can each represent individual features, functions and/or effects of the invention to be considered independently of one another, which each also develop the invention independently of one another. Therefore the example embodiments should also comprise combinations other than those in the explained forms of embodiment. What is more the described forms of embodiment can also be supplemented by further of the features, functions and/or effects of the invention already described.

The single FIG. 1 shows a schematic circuit diagram of an X-ray device with an X-ray tube connected to a circuit arrangement.

DETAILED DESCRIPTION OF THE EXAMPLE EMBODIMENTS

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. At least one embodiment of the present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the FIGURE. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

Inter alia, at least one embodiment of the invention is based on the idea that it is possible, through a suitable combination of the switching unit and the focusing unit, for a possibility to be able to be created to quickly switch over the grid cathode voltage or the electrical grid potential respectively from a pinch-off voltage or a pinch-off potential respectively to a predeterminable focusing voltage or a predeterminable focusing potential. In such cases the focusing unit can be used as an addition to switch the charge of or to discharge a parasitic electrical capacitance of the connection cable. Through the active charge switching of the grid capacitance or grid cathode capacitance and also the capacitance of the connecting cable by the switching unit and the focusing unit, a time constant for a switch from pinching off the flow of electrons to focusing the flow of electrons and thus an influence of the switching change on characteristics of the focal point can be reduced.

What is more it is possible, in particular with regard to a regulation of the grid cathode voltage or of the grid potential, to couple the focusing unit to an electrical potential of the cathode electrode, whereby a more precise focusing of the flow of electrons in the X-ray tube can be achieved. In this case a unidirectional transmission of a required value can be sufficient for a regulation. Thus transmission of an actual value, in particular taking into account a high potential difference when operating according to specification, can be saved.

What is more, at least one embodiment of the invention makes it possible to integrate the circuit arrangement into an X-ray device in a simple way. Savings in installation space and costs can be made by the inventive circuit arrangement.

The switching unit can basically have one or more suitable electromechanical switching elements in order to realize the desired switching function. Preferably the switching unit has one or more electronic switching elements however, in particular semiconductor switching elements, by which the desired switching function of the switching unit can be realized. The switching elements can be formed by transistors, thyristors, combinations hereof and/or the like for example.

For the intended use there can especially advantageously be provision for a number of electronic switching elements connected in series essentially to be operated synchronously. Through this, even with electronic switching elements, which can merely cope with a fraction of the voltage arising, operation with a far greater operating voltage than the maximum voltage allowed for a respective switching element can be achieved.

The switching unit provides at least one first switching state, in which the at least one grid electrode has a first electrical grid potential applied to it for pinching off the flow of electrons between the anode electrode and the cathode electrode. For this purpose the switching unit can be connected to a corresponding operating voltage source, wherein the switching unit couples the operating voltage source to the X-ray tube in such a way that the operating voltage source at least provides the pinch-off voltage between the grid electrode and the cathode electrode. In a second switching state of the switching unit the grid electrode can have a second electrical grid potential enabling the flow of electrons applied to it, and this can preferably be the grid potential, which is provided by the focusing unit. This can be achieved by connecting the switching unit in series with the focusing unit.

The fact that the switching unit and the focusing unit are connected in series enables at least the second electrical grid potential to be provided by the focusing unit. Through this the focusing unit can support a respective switchover of the switching unit, by which the functionality can be realized more reliably.

A grid cathode voltage in a range of around zero to around 500 V can be provided for focusing. This voltage can likewise be provided by the operating voltage source. For this purpose the focusing unit can adapt the voltage supplied by the operating voltage source accordingly for example.

As a rule the electrical potential of the grid electrode is negative in relation to the electrical potential of the cathode electrode. What is more, as a rule the electrical potential of the anode electrode is positive in relation to the cathode electrode.

The switching unit can have one or more switching elements. With a number of switching elements there can be provision for these to be at least partly connected in series, in order to be able to guarantee a predetermined blocking capability in the switched-off switching state of the switching unit. A switching element can be formed by one or more semiconductor switching elements. What is more the switching element can also comprise an electromechanical switching element, for example a relay, a contactor and/or the like. Basically the semiconductor switching element can also be formed by an electromechanical switching element or by any other suitable switching element.

The switching element, in particular the semiconductor switching element, can be formed by a transistor, in particular a field effect transistor, preferably a Metal Oxide Field Effect Transistor (MOSFET), an Insulated-Gate Bipolar Transistor (IGBT), but also by a Gate Turn-Off Thyristor (GTO) and/or the like or by any other type of switching element.

To provide the desired switching state of the switching unit the semiconductor switching elements are operated in switching mode. With regard to a semiconductor switching element using a transistor, switching mode means that, in a switched-on switching state between the terminals of the transistor forming a switching path a very small electrical resistance is provided, so that a high current flow with very small residual voltage is possible. In a switched-off switching state on the other hand the switching path of the transistor is at high resistance, which means that it provides a high electrical resistance, so that even with high electrical voltage present on the switching path there is essentially no or only a very small, in particular negligible, current flow present. This differs from a linear mode for transistors.

The control unit is connected at least to the at least one switching element, in particular the at least one semiconductor switching element, of the switching unit. Preferably the switching unit has its own communication interface, by which it is in communication with the control apparatus. Through this a switchover of the switching unit can also be controlled by way of the control apparatus. The control unit can also take over or provide further functions, in particular with regard to the focusing voltage, the pinch-off voltage, the provision of the operating voltage by the operating voltage source and/or the like. The control unit can be embodied electrically isolated from the circuit arrangement and is preferably connected galvanically separated to the latter.

The control unit itself can be provided as a separate physical unit. Preferably however it is a component of the circuit arrangement and especially preferably is arranged integrated into the arrangement.

The focusing unit can for example have at least one adjustable resistive element, for example a transistor, which is operated in linear mode, or the like. Through this it is possible, using the operating voltage source or the operating supply voltage provided by the source, to provide the desired grid cathode voltage for focusing.

What can thus be achieved through the series connection of the switching unit and the focusing unit is that the focusing unit can be deactivated via the switching unit in the first switching state, while in the second switching state of the switching unit it can be activated. In this case the focusing unit can at least partly support the switchover between the first and the second switching state.

In accordance with an advantageous development it is proposed that the first and/or the second electrical grid potential is set as a function of a predetermined electrical anode-cathode voltage between the anode electrode and the cathode electrode. This embodiment can take into account that not only the electrical pinch-off voltage or the electrical pinch-off potential but also the grid cathode voltage for focusing or the focusing voltage or the focusing potential can be dependent on the anode-cathode voltage. There can thus be provision for the pinch-off voltage likewise to increase with increasing anode-cathode voltage. Basically this can also be provided for the focusing voltage. This enables the function of the invention overall to be further improved.

What is more, this embodiment allows the invention to be able to be specifically adapted to a plurality of different X-ray devices or X-ray tubes and also to applications. Likewise an adaptation to specific operating states can be achieved through this, in order for example to be able to provide a desired X-ray radiation. In particular the invention is further improved in respect of its flexibility.

It is further proposed that the focusing of the flow of electrons is regulated via the focusing unit. Even with varying operating conditions, this enables an essentially constant setting for generating the X-ray radiation to be achieved. For this purpose the circuit arrangement can comprise a corresponding regulation circuit, which is coupled to a suitable measuring sensor. The measuring sensor can detect the emitted X-ray radiation for example and provide a suitable sensor signal for the circuit arrangement. The circuit arrangement can evaluate this sensor signal and undertake the setting of the grid potential as a function thereof.

In accordance with an advantageous development it is proposed that, for a switchover between the first and the second switching state, an operating voltage for the switching unit and/or the focusing unit is adapted. This embodiment proves to be especially advantageous when the same operating voltage of the operating voltage source is used for the switching unit and the focusing unit. In this case use can be made of the observation that the amount of the pinch-off voltage is as a rule markedly larger than the amount of the focusing voltage. With the switchover of the operating voltage or with the adaptation of the operating voltage it can consequently be achieved that switching losses, in particular taking into account the high electrical voltages present here, can be reduced. At the same time the switchover between the first and the second switching state can be supported by this, so that the switchover can be carried out more quickly.

It is further proposed that the focusing unit has a series circuit including an electrical resistor and a transistor and a central terminal of this series circuit is electrically coupled to the at least one grid electrode. In this way an adjustable electrical grid potential can be provided especially easily. What is more a high reliability can be achieved through this circuit structure, because the desired function can be provided with a few components. What is more, by driving the transistor accordingly, a switchover between the first and the second switching state can also be supported. This is especially easily possible with this embodiment. The focusing unit can be connected to the control unit and can receive a setting signal for the electrical grid potential from the unit.

In accordance with an advantageous development it is proposed that the grid electrode is coupled electrically to the central terminal via a damping resistor connected to the central terminal. This embodiment takes into account that undesired capacitive effects, for example the capacitance of the connecting line, can be effective not only during the setting of the electrical potential of the grid electrode, but under certain circumstances these can also have an adverse effect on the circuit arrangement. What can be achieved by the damping resistor is that current pulses occurring, in particular during a switchover between the first and the second switching state, can be damped. This enables the actuation safety and also the reliability to be further improved. However this embodiment also proves especially advantageous for reducing problems with regard to electromagnetic compatibility, in particular with regard to the emission of radio interference, which can be reduced by this. Through a suitable choice of a resistance value of the electrical resistor, at the same time a high switching speed can be achieved during a switchover and/or also a high setting speed during focusing.

It also proves especially advantageous for an operating voltage source to be embodied to provide the operating voltage for supplying the focusing unit as a function of a switching state of the switching unit. With just the series connection of the switching unit and the focusing unit not only can the switchover be supported thereby but in particular in the operating state of the second switching state, in which the focusing of the flow of electrons is activated, in operation according to specification a power loss of the focusing unit can be reduced. This not only allows electrical energy to be saved, but at the same time also allows the size to be reduced, since components, in particular with regard to the focusing unit, as well as physical volume, in particular with regard to the cooling functionality, can be reduced.

Preferably the focusing unit has a series resistor for connection to the operating voltage source. The series resistor can be the electrical resistor, which is connected in series with the transistor of the focusing unit. The series resistor can make it possible to bring the focusing unit into a predeterminable defined operating state, so that with high reliability a precise regulation of the grid potential of the grid electrode can be achieved.

What is more it is proposed that an inverse diode is connected in parallel to the series resistor. The inverse diode makes it possible to include the operating voltage source in a supporting manner at least during a switchover between the first and the second switching state. This enables the operating voltage source to be used additionally to support the transfer of the parasitic capacitances of the connecting cable and/or of the grid cathode capacitance.

There can further be provision for a capacitor to be connected in parallel to the focusing unit and/or to the switching unit. A switchover between the first and the second switching state can also be supported by this. In particular the switching process from the first switching state to the second switching state can be greatly supported when both the focusing unit and also the switching unit each have a parallel-connected capacitor. It is then namely possible for these capacitors to accept or to provide a part of the electrical charge, which is required for the respective switchover. This embodiment proves especially advantageous in connection with the inverse diode, whereby an especially fast transfer of electrical charge from the connecting line and/or the grid electrode into the at least one capacitor can be made possible. The switchover can be further speeded up by this.

With regard to the X-ray device it is further proposed that the X-ray device has a voltage sensor for detecting an electrical anode-cathode voltage and for providing a voltage sensor signal for the circuit arrangement. Through the voltage sensor it is possible to set the circuit arrangement as a function of the detected anode-cathode voltage and thereby to further improve or to optimize the function of the circuit arrangement. For example the pinch-off voltage and/or the focusing voltage can be set and/or even regulated as a function of the voltage sensor signal.

It is further proposed that the X-ray device has a focusing sensor for detecting a focusing of the flow of electrons from the cathode electrode to the anode electrode and for providing a focusing sensor signal for the circuit arrangement. This makes possible a regulation for the focusing voltage, so that the optimal respective focusing voltage or the focusing potential can preferably be provided by the circuit arrangement. The function of the invention can be further improved by this. To this end the focusing sensor can detect an emitted X-ray radiation for example. For this purpose the circuit arrangement can further be embodied to evaluate the focusing sensor signal accordingly.

The advantages and effects specified for embodiments of the inventive method apply equally for embodiments of the inventive circuit arrangement as well as for the X-ray device equipped with embodiments of the inventive circuit arrangement and vice versa. Features formulated in accordance with the method can thus also be formulated in accordance with the facility and vice versa.

FIG. 1 shows a schematic circuit diagram of an X-ray device 10 with an X-ray tube 12, which has an anode electrode 14 and a cathode electrode 16, which are arranged in an evacuated vessel. Arranged between the anode electrode 14 and the cathode electrode 16 is a grid electrode 18. The anode electrode 14 is electrically connected to a terminal 52, the grid electrode to a terminal 50 and the cathode electrode 16 to two terminals 46, 48. For heating purposes the cathode electrode 16 has two terminals, namely the terminals 46 and 48, via which the cathode electrode 16 can be supplied electrically with an energy, to heat up the cathode electrode 16 to a predeterminable temperature during operation according to specification, so that the desired electron emission can be achieved. For this purpose the terminals 46, 48 are electrically connected to an electrical heat energy source 54.

The terminals 48, 52 are further electrically connected to a voltage source 56, which provides an anode-cathode voltage 72, which is essentially also present between the cathode electrode 16 and the anode electrode 14. An anode potential of the anode electrode 14 is as a rule greater than a cathode potential of the cathode electrode 16.

Depending on an electrical grid potential at the grid electrode 18, electrons emerging from cathode material of the cathode electrode 16 forming a flow of electrons 26 are accelerated to the anode electrode 14. When the electrons strike the anode electrode 14, which is embodied as a rule as a rotating electrode, X-ray radiation is generated and emitted by the X-ray tube 12.

The function of the X-ray tube 12 can be influenced by the grid potential at the grid electrode 18. In this way it is possible on the one hand to apply a first electrical grid potential to the grid electrode 18, with which a pinching-off of the flow of electrons 26 between the anode electrode 14 and the cathode electrode 16 can be achieved. The first electrical grid potential is also referred to as the pinch-off potential. Accordingly a grid cathode voltage is produced, which consequently is referred to as the pinch-off voltage. The pinch-off voltage can for example lie in a range of around zero to around 4 kV with X-ray tubes. In the present embodiment the pinch-off voltage lies at more than around 500 V, for example around 3.5 kV or even more. As a rule the grid potential is at least for pinching off the flow of electrons 26 negative in relation to the cathode potential of the cathode electrode 16.

The first electrical grid potential is as a rule chosen so that a safe, reliable pinching-off of the flow of electrons 26 can be achieved, without damaging electrical insulation in the X-ray device 10. In many cases the maximum permitted grid cathode voltage carries approx. 4 kV, which is why the X-ray device 10 with its components is embodied accordingly for this voltage.

During the pinching-off of the flow of electrons 26 essentially no X-ray radiation is generated, because the flow of electrons 26 is essentially suppressed.

What is more a second electrical grid potential can be applied to the grid electrode 18, which allows an enabling, in particular focusing, of the flow of electrons 26. A corresponding grid cathode voltage is also referred to as the focusing voltage. With the focusing voltage it is possible not only to enable the flow of electrons 26, preferably in a controlled manner, but at the same time also to control the focusing of the flow of electrons 26 with regard to how they strike the anode electrode 14. For example this enables a focal point 58 on the anode electrode 14 to be reached in a predeterminable manner. This enables the generation of X-ray radiation to be influenced over a wide range.

At the electrical terminals 46, 48, 50 a first terminal is connected to a connecting line 20. An opposite terminal of the connecting line 20 is connected to electrical terminals 60, 62, 64.

Connected to the electrical terminals 60, 62 is the heat energy source 54. A circuit arrangement 22 is connected to the electrical terminals 62, 64, by which the electrical grid potential for the grid electrode 18 can be provided in a predetermined manner. What is more, it is evident from FIG. 1 that the connecting line 20 has line capacitance, which is represented symbolically in FIG. 1 by a capacitor 66. The capacitor 66 further comprises a grid cathode capacitance of the X-ray tube 12, which is not further shown in FIG. 1 however. The capacitance 66 can for example have a capacitance of around 4 nF. This is relevant for the control of the X-ray tube with regard to the pinching-off of the flow of electrons 26 and also the focusing of the flow of electrons 26 only via the grid electrode 18, as will be further explained below.

In the present example a grid cathode voltage of around zero to around 500 V is needed for the focusing. Depending on construction of the X-ray tube 12 this voltage can also deviate, as can the pinch-off voltage.

For providing the grid potential the circuit arrangement 22 has an operating voltage source 38, which has an internal resistance 68, via which elements and modules of the circuit arrangement 22 are supplied with electrical energy for operation according to specification.

The circuit arrangement 22 further comprises a focusing unit 24, which is connected in series with a switching unit 28. This series circuit including the focusing unit 24 and the switching unit 28 is connected via the internal resistor 68 to the operating voltage source 38 and has an operating voltage applied to it by the source.

In the present example the switching unit 28 provides two switching states, namely a switched-off switching state as first switching state and a switched-on switching state as second switching state. In the switched-on switching state the operating voltage is essentially present at the focusing unit 24. The focusing unit 24, as will be further explained below, provides a grid cathode voltage, which allows the flow of electrons 26 to be able to be focused in a predeterminable manner.

In the first switching state of the switching unit 28, in which the switching unit 28 is in the switched-off switching state, the focusing unit 24 is essentially deactivated, so that between the grid electrode 18 and the cathode electrode 16 roughly the operating voltage of the operating voltage source 38 is provided. It should be noted in this case that in this operating state, at least in a settled state, essentially no electrical current is flowing. Thus when the operating voltage amounts to around 3.5 kV then this operating voltage is also present in the switched-off switching state of the switching unit 28 between the grid electrode 18 and the cathode electrode 16. This voltage is negative in the present case, so that the grid potential is smaller than the cathode potential. Consequently in this switching state a pinching-off of the flow of electrons 26 is achieved, so that essentially electrons are no longer reaching the anode electrode 18 and thus the generation of X-ray radiation is essentially interrupted.

In the second switching state of the switching unit 28, namely the switched-on switching state, the focusing unit 24 has the operating voltage applied to it. The focusing unit 24 then provides a corresponding electrical grid potential, so that not only is the flow of electrons 26 enabled, but also a corresponding predeterminable focusing of the flow of electrons 26 when they strike the anode electrode 14 can be achieved.

For this purpose the focusing unit 24 comprises at least one series circuit including an electrical resistor 30, which can serve at the same time as a series resistor with regard to connection of the operating voltage source 38, and a transistor 32, which is formed in the present example by a field effect transistor, and indeed by a self-blocking re-channel MOSFET. Depending on embodiment however another transistor can also be used here, in particular also a bipolar transistor.

In the present example the transistor 32 has a gate terminal which is not labeled and which is connected to a likewise not shown driver circuit, which applies a predeterminable electrical gate potential to the gate terminal, so that the predeterminable electrical grid potential can essentially be provided at a central terminal 34 of this series circuit. For this purpose the transistor 32 is operated in a linear mode, so that the respective grid potential is set at the central terminal 34 depending on the respective setting of the gate potential at the transistor 32. As can be seen from the diagram in FIG. 1, the focusing unit 24 is activated by the switching-on of the switching unit 28 and deactivated by switching it off.

With a switchover between the first and the second switching state or between the switched-on and the switched-off switching state of the switching unit 28 significant electrical potential jumps can occur at the central terminal 34. Taking into account the capacitance 66, this can be problematic at least for the focusing unit 24 or can demand an expensive construction.

In order to reduce the effect of the capacitance 66, the circuit arrangement 22 therefore has a damping resistance 36, which is connected between the central terminal 34 and the electrical terminal 62. Thus, through a suitable choice of the electrical resistance value, the effect of the capacitance 66 can be reduced, without the switching characteristics being significantly influenced.

Even if the electrical resistor 36 is connected in the present example between the central terminal 34 and the electrical terminal 62, as an alternative or in addition it can also be arranged between a terminal of the switching unit 28 at an electrical reference potential 70 and the terminal 64, without any significant adverse effect on the function.

If a switchover of the switching state from the switched-off switching state to the switched-on switching state of the switching unit 28 occurs, then this can lead during the switchover, to the operating voltage of the operating voltage source 38 essentially being present at the transistor 32. Through a rapid regulation however the conductivity of the transistor 32 increases almost instantly, so that the electrical potential at the central terminal 34 increases to a value for focusing the flow of electrons 26. This also requires a discharging of the capacitance 66.

In order to support the switchover, a capacitor 42, 44 is connected in parallel both to the focusing unit 24 and also to the switching unit 28. In conjunction with the inverse diode 40, which is connected in parallel at the electrical resistance 30, an additional effect can thus be achieved during the switchover, so that an electrical load in respect of the transistor 32 can be reduced. The switching-on of the switching unit 28 thus makes it possible, via the capacitors 42, 44 to provide a voltage divider functionality in the switched-off switching state, which is used when the switching unit 28 is switched on to support this discharging of the capacitance 66. The inverse diode 40 also serves this purpose, which for this case bridges the electrical resistor 30, which can also be used as a series resistor.

When the switching unit 28 is switched off the focusing unit 24 is deactivated and the capacitor 44 is charged via the transistor 32. At the same time the capacitance 66 is also charged via the damping resistor 36. The capacitor 42 serves in this case as an additional energy source and supports the charging of the capacitors 44 and the capacitance 66.

In the present embodiment, there is further provision for the operating voltage source 38 to be able to be switched over to provide the operating voltage. The switchover of the operating voltage can be done together with the switchover of the switching unit 28. This in particular allows switching losses with regard to the focusing unit 24 to be reduced. Thus there can be provision for the switched-on switching state of the switching unit 28 for the operating voltage source 38 to provide an operating voltage in a range of around 500 V, while the operating voltage source 38 in the switched-off switching state of the switching unit 28 provides an operating voltage of around 3.5 kV.

In the present embodiment, there is further provision for a driver unit for the transistor 32 not shown to be coupled electrically to the reference potential 70. Since the electrical potential of the source gate of the transistor 32 is dependent in the present example on the switching state of the switching unit 28, the gate terminal of the transistor 32 can be decoupled via a corresponding diode decoupling circuit. This enables the overloading of the gate terminal to be avoided with regard to an application of voltage. This is not shown in FIG. 1 however.

With the capacitive voltage divider formed by the capacitors 42, 44 a division of voltage with regard to the focusing unit 24, in particular the transistor 32, and the switching unit 28 can be achieved. What is more a rise in voltage at the transistor 32 when the switching unit 28 is switched on can be better restricted. A voltage curve at the capacitor 42 is essentially constant.

Even if in the present example the switching unit 28 is electrically coupled to the reference potential 70, the series circuit including the focusing unit 24 and the switching unit 28 can basically also be swapped without adversely affecting the function of the invention thereby. With such an arrangement the inverse diode 40 can also be saved for example.

What is more, in the present embodiment, the reference potential 70 is related to the negative electrical potential of the operating voltage source 38. Basically the reference potential can however also be connected to the positive electrical potential of the operating voltage source 38. With such an embodiment it is expedient however for an activation of the transistor 32 and of the switching unit 28 to be able to be done with separate potentials or potential-free.

There can be a regulation by the circuit arrangement 22 of a grid focusing potential to be set precisely. Only a required value in each case is to be transferred via a potential separation.

The invention allows the operating voltage source 38 with the circuit arrangement 22 to be arranged in the X-ray device 10. The operating voltage source 38 can for example comprise a transistor with a rectification, which is arranged in the X-ray device 10. What is more, further combinations are technically possible. If the circuit arrangement 22 is arranged integrated into the X-ray device 10, line capacitances, in particular the capacitance 66, can also be reduced by this.

The example embodiments serve exclusively to explain the invention and are not intended to restrict the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for controlling an X-ray tube including at least one grid electrode, the at least one grid electrode being arranged between an anode electrode and a cathode electrode, and the method comprising:

focusing, via a focusing unit, a flow of electrons from the cathode electrode to the anode electrode;

applying, via a switching unit, a first electrical grid potential to the at least one grid electrode in a first switching state to pinch off the flow of electrons between the anode electrode and the cathode electrode; and applying a second electrical grid potential to the at least one grid electrode in a second switching state to enable the flow of electrons, at least the second electrical grid potential being provided by the focusing unit.

2. The method of claim 1, wherein at least one of the first electrical grid potential or the second electrical grid potential is provided as a function of an electrical anode-cathode voltage between the anode electrode and the cathode electrode.

3. The method of claim 2, wherein the focusing of the flow of electrons is regulated via the focusing unit.

4. The method of claim 2, wherein an operating voltage for at least one of the switching unit or the focusing unit is adapted for a switchover between the first switching state and the second switching state.

5. The method of claim 1, wherein the focusing of the flow of electrons is regulated via the focusing unit.

6. The method of claim 5, wherein an operating voltage for at least one of the switching unit or the focusing unit is adapted for a switchover between the first switching state and the second switching state.

7. The method of claim 1, wherein an operating voltage for at least one of the switching unit or the focusing unit is adapted for a switchover between the first switching state and the second switching state.

8. The method of claim 1, wherein the at least the second electrical grid potential is provided by the focusing unit based on a series connection between the focusing unit and the switching unit.

9. The method of claim 1, wherein the focusing unit is activated or deactivated according to switching of the switching unit.

10. The method of claim 1, wherein the focusing comprises operating at least one adjustable resistive element of the focusing unit in a linear mode.

11. The method of claim 1, wherein the focusing unit comprises an adjustable resistive element; and the at least the second electrical grid potential is provided by the focusing unit based on a series connection between the adjustable resistive element and the switching unit.

12. A circuit arrangement for controlling an X-ray tube, the X-ray tube including at least one grid electrode arranged between an anode electrode and a cathode electrode, and the circuit arrangement comprising:

a focusing unit to focus a flow of electrons from the cathode electrode to the anode electrode; and a switching unit to apply a first electrical grid potential to the at least one grid electrode in a first switching state for pinching off the flow of electrons between the anode electrode and the cathode electrode, apply a second electrical grid potential in a second switching state for enabling the flow of electrons, the switching unit and the focusing unit being connected in series.

13. The circuit arrangement of claim 12, wherein the focusing unit includes a series circuit including an electrical resistor and a transistor, a central terminal of the series circuit being electrically coupled to the at least one grid electrode.

14. The circuit arrangement of claim 13, wherein the at least one grid electrode is electrically coupled to the central terminal via a damping resistor.

15. The circuit arrangement of claim 13, further comprising:

an operating voltage source to provide an operating voltage for supplying the focusing unit as a function of a switching state of the switching unit.

16. The circuit arrangement of claim 13, further comprising:

a capacitor connected in parallel to at least one of the focusing unit or the switching unit.

17. The circuit arrangement of claim 12, further comprising:

an operating voltage source to provide an operating voltage for supplying the focusing unit as a function of a switching state of the switching unit.

18. The circuit arrangement of claim 17, wherein the focusing unit includes a series resistor for connection to the operating voltage source.

19. The circuit arrangement of claim 18, wherein an inverse diode is connected in parallel to the series resistor.

20. The circuit arrangement of claim 18, wherein the focusing unit includes a transistor connected in series to the series resistor.

21. The circuit arrangement of claim 17, further comprising:

a capacitor connected in parallel to at least one of the focusing unit or the switching unit.

22. The circuit arrangement of claim 12, further comprising:

a capacitor connected in parallel to at least one of the focusing unit or the switching unit.

23. An X-ray device comprising:

an X-ray tube including at least one grid electrode, the at least one grid electrode being arranged between an anode electrode and a cathode electrode; and the circuit arrangement of claim 12 connected via a connecting line to the X-ray tube for controlling the X-ray tube.

24. The X-ray device of claim 23, further comprising:

a voltage sensor to detect an electrical anode-cathode voltage, and provide a voltage sensor signal for the circuit arrangement.

25. The X-ray device of claim 23, further comprising:

a focusing sensor to detect a focusing of a flow of electrons from the cathode electrode to the anode electrode, and provide a focusing sensor signal for the circuit arrangement.

26. The circuit arrangement of claim 12, wherein the focusing unit comprises at least one adjustable resistive element configured to be operated in a linear mode.

27. The circuit arrangement of claim 12, wherein the focusing unit is activated or deactivated according to switching of the switching unit.

28. The circuit arrangement of claim 12, wherein the focusing unit comprises an adjustable resistive element; and the switching unit and the adjustable resistive element are connected in series.

* * * * *